United States Patent [19]

Nakashiki et al.

[11] 3,945,735

[45] Mar. 23, 1976

[54] SOCKET FOR HOLDING THE WRITING BALL OF A BALL POINT PEN

[75] Inventors: Koso Nakashiki; Akira Yoshimoto; Kazuhiko Osaki, all of Kure, Japan

[73] Assignee: The Sailor Pen Co., Ltd., Tokyo, Japan

[22] Filed: Dec. 30, 1974

[21] Appl. No.: 537,138

[30] Foreign Application Priority Data

Jan. 30, 1974 Japan ..... 49-11983
Mar. 5, 1974 Japan ..... 49-25240

[52] U.S. Cl. ..... 401/216
[51] Int. Cl. ..... B43k 7/10
[58] Field of Search ..... 401/209–216

[56] References Cited

UNITED STATES PATENTS 1,527,971 3/1925 Forsell et al. ..... 401/216
3,537,801 11/1970 Corte ..... 401/216

FOREIGN PATENTS OR APPLICATIONS 464,200 7/1951 Italy ..... 401/209
935,473 2/1945 France ..... 401/209

*Primary Examiner*—Lawrence Charles
*Attorney, Agent, or Firm*—Flynn & Frishauf

[57] ABSTRACT

A socket for holding the writing ball of a ball point pen comprising an outer tubular member having a circular cross section and an inner tubular member having an elliptic or circular cross section, wherein an ink-conducting chamber or chambers are defined between the inner peripheral wall of the outer tubular member and the outer peripheral wall of the inner tubular member, thereby enabling ink to be conducted smoothly from an ink cartridge provided in the ball point pen through the chambers to the writing ball.

25 Claims, 9 Drawing Figures

SOCKET FOR HOLDING THE WRITING BALL OF A BALL POINT PEN

BACKGROUND OF THE INVENTION

1. Field of the Invention

This invention relates to a socket for the writing ball of a ball point pen and more particularly to a socket for the writing ball of a ball point pen provided with a very easily formed ink passage for conducting aqueous ink from the ink cartridge to the writing ball of the ball point pen.

2. Description of the Prior Art:

A socket for the writing ball of the prior art ball point pen comprises a tubular member, a writing ball held in the forward end portion of the tubular member, a ball-bearing rod of circular cross section inserted into the tubular member with a recessed seat provided at the forward end of the rod to receive the writing ball, and an ink passage consisting of a groove formed along the full length of the ball-bearing rod. However, the socket of the prior art ball point pen has the drawbacks that since the ball-bearing rod is made of sufficiently hard metal to be saved from abrasion by the rotation of the writing ball, considerable difficulties are presented in machining an ink passage in the ball-bearing rod, resulting in high working cost.

It is accordingly the object of this invention to provide a socket for a ball point pen which includes an inner metal tubular member, enabling an ink passage to be very easily provided without machining an abrasion-resistant ball-bearing rod.

SUMMARY OF THE INVENTION

According to this invention, there is provided a ball point pen socket which comprises an outer tubular member of circular cross section, an inner tubular member of elliptic or circular cross section forced into the outer tubular member, a ball-bearing rod having a recessed seat formed in one end face and inserted into the inner tubular member, and a writing ball rotatably held between the recessed seat and a crimped or deformed portion of the outer tubular member which is positioned near the recessed seat. Since the inner peripheral wall of the outer tubular member and the outer peripheral wall of the inner tubular member constitute an ink passage, the ball point pen socket of this invention eliminates the necessity of machining a grooved ink passage in the ball-bearing rod as is the case with the prior art ball point pen socket.

DESCRIPTION OF THE PREFERRED EMBODIMENTS

Throughout the drawings, similar parts are denoted by the same numerals.

Figure 1:
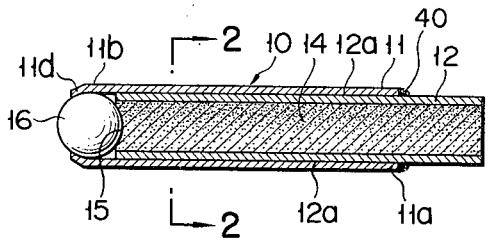
FIG. 1 is a longitudinal sectional view of a socket according to an embodiment of this invention for holding the writing ball of a ball point pen.
Figure 2:
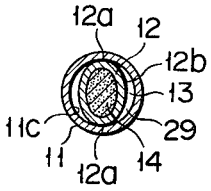
FIG. 2 is a sectional view on line 2—2 of FIG. 1.

Referring to FIGS. 1 and 2, a socket 10 comprises an outer tubular member 11 having a circular cross section, and an inner tubular member 12 which is made longer than said outer tubular member 11 with an elliptic cross section. The inner tubular member 12 is inserted from the rear end 11*a* of the outer tubular member 11 up to the proximity of the forward end 11*b* of the outer tubular member 11 with the vertices 12*a* (FIG. 2) of the inner tubular member 12 pressed against the inner peripheral wall 11*c* of the outer tubular member 11. The rear end of the outer tubular member 11 and the corresponding portion of the inner tubular member 12 are joined, for example, by welding (see weld 40 of FIG. 1) or crimping (not shown) of the rear end of the tubular member 11.

The inner tubular member 12 is fabricated by deforming the full length of a metal pipe of circular cross section so as to have a desired elliptic cross section by means of a press or press roll. The inner peripheral wall 11*c* of the outer tubular member 11 and the outer peripheral wall 12*b* of the inner tubular member 12 jointly define, as shown in FIG. 2, a pair of symmetrical crescent ink passages or ink conducting chambers 13. These ink passages 13 open at the forward end to the interior of the forward end portion 11*b* of the outer tubular member 11 and at the rear end 11*a* to the outside of the outer tubular member 11.

FOrced into the inner tubular member 12 is a ball-bearing rod 14 (FIG. 1) made of material having prominent resistance to abrasion caused by the rotation of the writing ball and corrosion by ink, for example, synthetic resins such as nylon impregnated with molybdenum disulfide and carbon fiber-reinforced plastics (CFRP), bearing material like brass or sintered alloy. The ball-bearing rod 14 has an elliptic cross section complementary to an outline defined by the inner peripheral wall 11*c* of the outer tubular member 11. Provided at the forward end of the ball-bearing rod 14 is a recessed seat 15, the inner wall of which constitutes part of a spherical plane.

A writing ball 16 is held in the forward end portion 11*b* of the tubular member 11 while being pinched between the supporting seat 15 and the crimped or deformed forward end portion 11*d* of the outer tubular member 11, such that the writing ball 16 can rotate within the forward end portion 11*b* but cannot be displaced in the axial nor radial direction of the tubular member 11.

Figure 3:
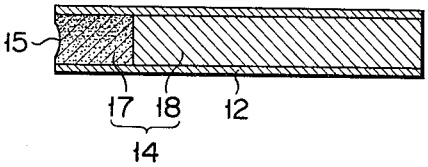
FIG. 3 is a longitudinal sectional view of a modified ball-bearing rod used with the socket of this invention.

FIG. 3 shows an inner tubular member 12 and a ball-bearing rod 14 received therein, both of which are taken out of a different type of socket from that of FIGS. 1 and 2. The embodiment of FIG. 3 differs from that of FIGS. 1 and 2 in that the ball-bearing rod 14 comprises a ball-bearing element 17 having a recessed seat 15 formed in the forward end face to receive a writing ball and constituting the forward end portion of the rod 14 and stem 18 forming the remaining portion of the rod 14. Both ball-bearing element 17 and stem 18 have an elliptic cross section complementary to an outline defined by the inner wall of the inner tubular member 12. While the ball-bearing element 17 of FIG. 3 may be of the same material as the ball-bearing rod of FIGS. 1 and 2, the stem 18 should be formed of material resistant to corrosion by ink. The stem 18 serves to prevent the rod 14 from being displaced to the right side of FIG. 3 by writing pressure applied through the writing ball 16.

Figure 4:
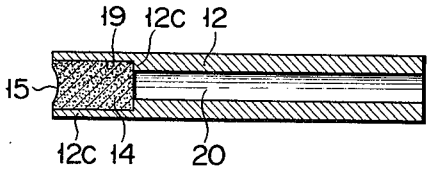
FIG. 4 is a longitudinal sectional view of a modified inner tubular member and modified ball-bearing rod used with the socket of this invention.

FIG. 4 indicates an inner tubular member 12 and a ball-bearing rod 14 received therein, both of which are taken out of a socket according to another embodiment of this invention. The inner tubular member 12 is made with a thicker wall than that of FIGS. 1 and 2 as well as of FIG. 3 and has a larger diameter section 19 formed in the forward end portion 12*c*. According to the embodiment of FIG. 4, the ball-bearing rod 14 which is of the same material as that of FIGS. 1 and 2, and as short as the larger diameter section 19 is inserted into the section 19. The hollow section 20 of the inner tubular member 12 into which the ball-bearing rod 14 is not inserted is open to the outside at the rear end of the inner tubular member 12 and has a smaller diameter than the inner diameter of the end portion 12*c*. Therefore, that hollow section 20 has a far more limited free space than that defined by the inner peripheral wall of the inner tubular member 12 of FIGS. 1 and 2, as well as of FIG. 3. This construction prominently reduces the amount of ink which might otherwise be lost by being diverted into the hollow section 20. The short ball-bearing rod 14 of the embodiments of FIGS. 3 and 4 saves the consumption of expensive material in making the rod 14.

Further, the ball-bearing rod 14 buts against the stepped portion 12*c* of the inner tubular member 12 defined by the larger diameter section 19 with the succeeding smaller diameter hollow section 20, thereby being prevented from being dislaced rearward by writing pressure.

There will now be described by reference to FIG. 5 a ball point pen barrel 21, in which a feed 22 is concentrically received. The smaller diameter forward end portion 22*a* of said feed 22 is fitted into an axial bore 24 formed in the forward end portion 23 of the barrel 21. The rear end of the feed 22 is connected to an ink cartridge (not shown). A groove extending along the full length of the feed 22 except for its forward end portion 22*a* constitutes an ink passage 25. In the bore 24, a ring member 26 made of elastic material, for example, rubber is provided ahead of the forward end portion 22*a* of the feed 22. The feed 22 further has a cylindrical bore 27 having the same diameter as that of the outer tubular member 11 of the socket 10 and extending from the tip of the forward end portion 22*a* of the feed 22 to the adjacent section thereof which is not reduced in diameter. That portion of the barrel 21 which is disposed adjacent to its forward end portion 23 has an air hole 28 provided in a space 21*a* defined between the barrel 21 and feed 22 in order to introduce air into the space 21*a* or remove it therefrom for control of the amount and pressure of air present in the space 21*a*.

The socket 10 is inserted into the cylindrical bore 27 through the hole 23*a* at the tip of the forward end portion 23 of the barrel 21 and the central hole 26*a* of the ring member 26 so as to expose the writing ball 16 to the outside. The socket 10 is elastically held by the ring member 26 to be prevented from falling out of forward end portion 23 of the barrel 21.

Figure 5:
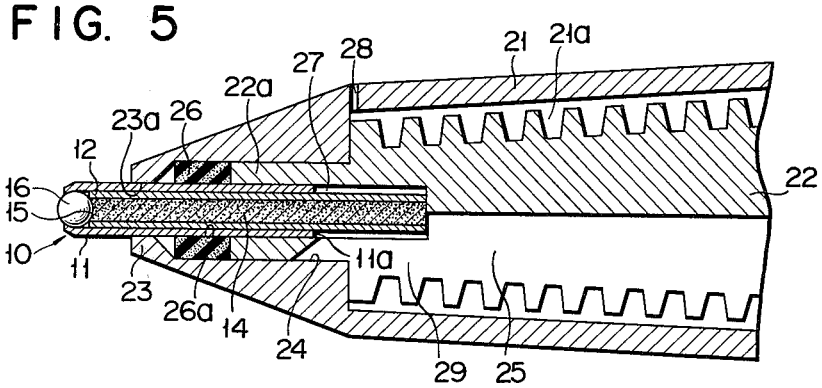
FIG. 5 is a longitudinal sectional view of the tip portion of a ball point pen barrel into which the socket of FIG. 1 is inserted.

In FIG. 5, aqueous ink 29 brought from the ink cartridge (not shown) through the ink passage 25 to the rear end 11*a* of the outer tubular member 11 is further conducted from the rear end 11*a* into the ink passages or conducting chambers 13 (FIG. 2) and then to the writing ball 16. The writing ball 16 rotated on writing material, for example, paper supplies ink to the paper, effecting impression thereon.

Figure 6:
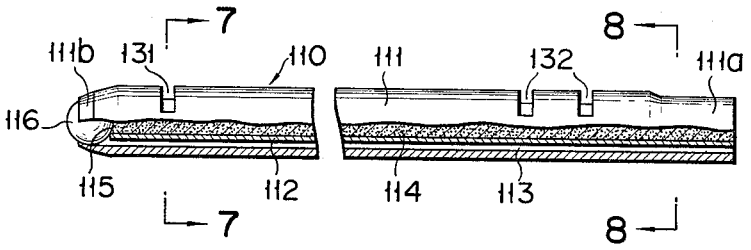
FIG. 6 is a side view, partly in section, of a socket according to another embodiment of this invention.
Figure 7:
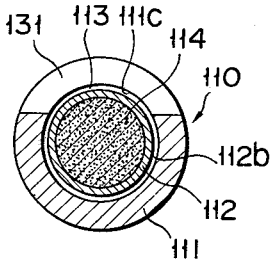
FIG. 7 is a sectional view on line 7—7 of FIG. 6.

There will now be described by reference to FIGS. 6 and 7 a ball point pen socket according to still another embodiment of this invention. A socket 110 comprises an outer tubular member 111 having a circular cross section except for the rear end portion 111*a*, an inner tubular member 112 formed with a smaller outer diameter than the inner diameter of the outer tubular member 111, a ball-bearing rod 114 provided with a recessed partly spherical seat 115 at the forward end face and tightly inserted into the inner tubular member 112, and a writing ball 116 rotatably held by the crimped or deformed forward end portion 111*b* of the outer tubular member 111 and the recessed seat 115 of the ball-bearing rod 114.

Figure 8:
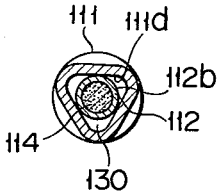
FIG. 8 is a sectional view on line 8—8 of FIG. 6.

The rear end 111*a* of the outer tubular member 111 has its cross section deformed into an equilateral triangle as shown in FIG. 8. The inner wall 111*d* of the rear end 111a firmly holds the outer periphery 112*b* of the rear end portion of the inner tubular member 112, causing the latter to be concentrically received in the outer tubular member 111. The inner peripheral wall 111*c* of the outer tubular member 111 and the outer peripheral wall 112*b* of the inner tubular member 112 jointly define an ink passage or conducting chamber 113. In this case, the outer tubular member 111 is chosen to have an outer diameter of for example, 1.2 mm, and an interval between both outer and inner tubular members 111, 112 is set at, for example, 0.03 mm. The forward end of the ink conducting chamber 113 communicates with the interior of the forward end portion 111*b* of the outer tubular member 111. The rear end of the ink conducting chamber 113 is open to the outside of the socket 110 through a free space 130 defined between the inner wall 111*d* of the rear end portion 111*a* of the outer tubular member 111 and the outer peripheral wall 112*b* of the inner tubular member 112.

The outer tubular member 111 has an air hole 131 communicating with the ink conducting chamber 113 at a point near the forward end portion 111*b* of the outer tubular member 111 and ink passages 132 communicating with the ink conducting chamber 113 at points near the rear end portion 111a of the outer tubular member 111. The ball-bearing rod 114 is formed of the same material as the rods of FIGS. 1 to 4.

Figure 9:
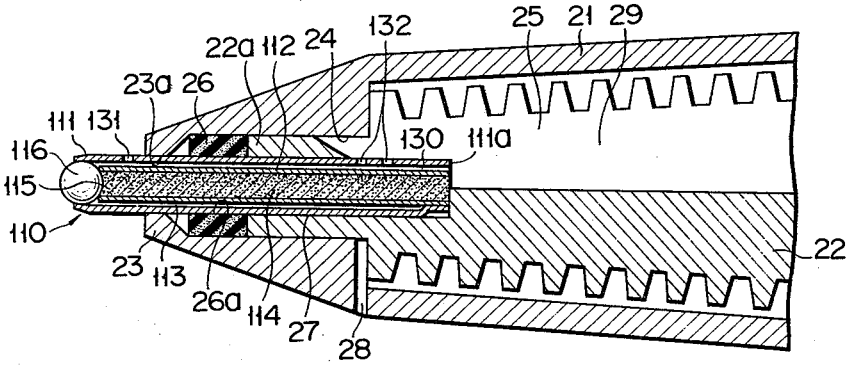
FIG. 9 is a longitudinal sectional view of the tip portion of a ball point pen barrel into which the socket of FIG. 6 is inserted.

A ball point pen barrel 21 and its forward end portion 23 of FIG. 9 are constructed in the same manner as in FIG. 5, and the same parts are denoted by the same numerals, description thereof being omitted.

The socket 110 is inserted into the hole 27 of a feed 22 from the tip of the forward end portion 23 of the barrel 21 so as to expose the air hole 131 to the outside and held by a ring member 26 to be prevented from falling off the forward end portion 23.

In operation, aqueous ink 29 brought from an ink cartridge (not shown) into the ink passage 25 in the feed 22 flows from the rear end portion 111*a* of the socket 110 through the free space 130 and from the outer periphery of the outer tubular member 111 through the ink passages 132 into the ink conducting chamber 113, and finally reaches the writing ball 116 while driving air present in the ink conducting chamber 113 to the outside of the socket 110 through the air hole 131. The succeeding operation is carried out in the same manner as in FIG. 5. It will be noted that omission of the ink passages 132 does not obstruct the application of this invention. According to the foregoing description, the rear end portion 111a of the outer tubular member 111 was formed into an equilateral triangle.

What we claim is:

1. A socket for holding the writing ball of a ball point pen comprising:

an outer tubular member having a substantially circular cross section;

an inner tubular member of substantially elliptic cross section which is inserted into the outer tubular member, such that one end of said inner tubular member is positioned more inward of the socket than the corresponding end of said outer tubular member;

ink conducting chambers of substantially crescent cross section defined between the inner peripheral wall of the outer tubular member and the outer peripheral wall of the inner tubular member and extending along the full length of said inner tubular member;

a ball-bearing rod inserted into the inner tubular member; and a writing ball rotatably supported by one end of the outer tubular member and that end of the ball-bearing rod which is disposed adjacent to said one end of the outer tubular member.

2. A socket according to claim 1, wherein the ball-bearing rod is made of material resistant to abrasion caused by the rotation of the writing ball and corrosion by ink, and has a recessed seat formed at said end of the rod to receive the writing ball.

3. A socket according to claim 2, wherein the ball-bearing rod is made shorter than the inner tubular member and is inserted into the inner tubular member with said end of the rod made substantially flush with said one end of the inner tubular member.

4. A socket according to claim 3, wherein a larger diameter section is provided at said one end of the inner tubular member to receive the ball-bearing rod.

5. A socket according to claim 3, wherein the ball-bearing rod has the same length as the inner tubular member.

6. A socket according to claim 5, wherein the ball-bearing rod is made of synthetic resin.

7. A socket according to claim 6, wherein the ball-bearing rod is formed of nylon impregnated with molybdenum disulfide.

8. A socket according to claim 6, wherein the ball-bearing rod consists of carbon fiber-reinforced plastics.

9. A socket according to claim 5, wherein the ball-bearing rod is made of bearing metal.

10. A socket according to claim 5, wherein the ball-bearing rod is formed of sintered alloy.

11. A socket according to claim 1, wherein the ball-bearing rod comprises a ball-bearing element made of material resistant to abrasion caused by the rotation of the writing ball and corrosion by ink and received in said one end of the inner tubular member, and a stem formed of material resistant to corrosion by ink and extending from the ball-bearing element to the other end of the inner tubular member.

12. A socket according to claim 1, wherein the ball-bearing rod is made of synthetic resin.

13. A socket according to claim 12, wherein the ball-bearing rod is formed of nylon impregnated with molybdenum disulfide.

14. A socket according to claim 12, wherein the ball-bearing rod consists of carbon fiber-reinforced plastics.

15. A socket according to claim 1, wherein the ball-bearing rod is made of bearing metal.

16. A socket according to claim 1, wherin the ball-bearing rod is formed of sintered alloy.

17. A socket according to claim 1 wherein said ink conducted through said ink conducting chambers is aqueous ink.

18. A socket for holding the writing ball of a ball point pen comprising:

an outer tubular member having a polygonal cross section at one end and a substantially circular cross section in the remaining portion;

an inner tubular member having a smaller outer diameter than the inner diameter of the outer tubular member and concentrically inserted into the outer tubular member with one end of the inner tubular member forced into said one end of the outer tubular member;

a hollow substantially cylindrical ink-conducting chamber defined between the inner peripheral wall of the outer tubular member and the outer peripheral wall of the inner tubular member;

a ball-bearing rod inserted into the inner tubular member; and a writing ball rotatably held by the other end of the outer tubular member and the other end of the ball-bearing rod.

19. A socket according to claim 18, wherein said one end of the outer tubular member is made into an equilateral triangle.

20. A socket according to claim 18, wherein the ball-bearing rod is formed of synthetic resin.

21. A socket according to claim 20, wherein the ball-bearing rod is made of nylon impregnated with molybdenum disulfide.

22. A socket according to claim 20, wherein the ball-bearing rod consists of carbon fiber-reinforced plastics.

23. A socket according to claim 18, wherein the ball-bearing rod is made of bearing metal.

24. A socket according to claim 18, wherein the ball-bearing rod is formed of sintered alloy.

25. A socket according to claim 18 wherein said ink conducted through said ink conducting chambers is aqueous ink.

* * * * *